US011270650B2

(12) United States Patent
Seo et al.

(10) Patent No.: US 11,270,650 B2
(45) Date of Patent: Mar. 8, 2022

(54) DISPLAY DEVICE AND DRIVING METHOD THEREOF

(71) Applicant: Samsung Display Co., LTD., Yongin-si (KR)

(72) Inventors: Jung Deok Seo, Yongin-si (KR); Seung Kyu Lee, Yongin-si (KR); Min Seong Son, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/836,941

(22) Filed: Apr. 1, 2020

(65) Prior Publication Data

US 2020/0394962 A1 Dec. 17, 2020

(30) Foreign Application Priority Data

Jun. 11, 2019 (KR) ..... 10-2019-0068923

(51) Int. Cl.
*G09G 3/3266* (2016.01)
*G09G 3/3275* (2016.01)

(52) U.S. Cl.
CPC ..... *G09G 3/3266* (2013.01); *G09G 3/3275* (2013.01); *G09G 2300/0842* (2013.01); *G09G 2310/0278* (2013.01)

(58) Field of Classification Search
CPC ..... G09G 3/3266; G09G 3/3275; G09G 2310/0278; G09G 2300/0842
See application file for complete search history.

(56) References Cited

U.S. PATENT DOCUMENTS

| | | | | |
|---|---|---|---|---|
| 9,786,226 | B2 * | 10/2017 | Lee | G09G 3/3266 |
| 10,380,943 | B2 * | 8/2019 | Choi | G09G 3/3233 |
| 10,614,732 | B2 * | 4/2020 | Choi | G09G 3/3208 |
| 10,854,829 | B2 * | 12/2020 | Lee | H01L 51/0097 |
| 2015/0154913 | A1 * | 6/2015 | Kim | G09G 3/3233 345/691 |
| 2015/0170565 | A1 * | 6/2015 | Hong | G09G 3/3233 345/212 |
| 2016/0266695 | A1 * | 9/2016 | Bae | G06F 3/04166 |

(Continued)

FOREIGN PATENT DOCUMENTS

| | | |
|---|---|---|
| KR | 10-2018-0114981 | 10/2018 |
| KR | 10-2019-0014274 | 2/2019 |

(Continued)

*Primary Examiner* — Amy Onyekaba
(74) *Attorney, Agent, or Firm* — H.C. Park & Associates, PLC

(57) ABSTRACT

A display device including pixels connected to a p-type scan line, an n-type scan line, and a data line, to display an image in a first mode with a first frequency or a second mode with a second, lower frequency, a first scan driver to supply a p-type signal having a first voltage to the p-type scan line, and a second scan driver to supply an n-type signal having a second, greater voltage to the n-type scan line, the second mode includes a first period corresponding to one frame period and a second period including consecutive frame periods, in which during the first period, the scan drivers supply i number of corresponding signals to the p-type and n-type scan lines, respectively, and during at least one frame of the second period, the first scan driver supplies j number of p-type signals to the p-type scan line.

19 Claims, 9 Drawing Sheets

(56) References Cited

U.S. PATENT DOCUMENTS

| | | | | |
|---|---|---|---|---|
| 2017/0206837 | A1* | 7/2017 | Jeon | G09G 3/3258 |
| 2018/0075803 | A1* | 3/2018 | Lee | G09G 3/3233 |
| 2018/0158393 | A1* | 6/2018 | Woo | G09G 3/2014 |
| 2018/0158396 | A1* | 6/2018 | Lee | G09G 3/3266 |
| 2018/0197480 | A1* | 7/2018 | Choi | H04N 13/344 |
| 2018/0218678 | A1* | 8/2018 | Kwon | G09G 3/3266 |
| 2018/0240382 | A1* | 8/2018 | Choi | G09G 3/3696 |
| 2018/0261163 | A1* | 9/2018 | Hyun | G09G 3/003 |
| 2018/0293939 | A1* | 10/2018 | Kim | H01L 51/5203 |
| 2018/0322831 | A1* | 11/2018 | Kim | G09G 3/3266 |
| 2019/0035351 | A1* | 1/2019 | Pyun | G09G 3/3688 |
| 2019/0057650 | A1* | 2/2019 | Choi | G09G 3/3233 |
| 2019/0096330 | A1* | 3/2019 | Kim | G09G 3/3266 |
| 2019/0096331 | A1* | 3/2019 | Kwon | G09G 3/3266 |
| 2019/0096332 | A1* | 3/2019 | Park | G09G 3/3225 |
| 2019/0147798 | A1* | 5/2019 | Hwang | G09G 3/3233 345/691 |

FOREIGN PATENT DOCUMENTS

| | | |
|---|---|---|
| KR | 10-2019-0020261 | 2/2019 |
| KR | 10-2019-0034375 | 4/2019 |
| KR | 10-2020-0040344 | 4/2020 |

* cited by examiner

SECOND MODE

SECOND MODE

SECOND MODE

SECOND MODE

DISPLAY DEVICE AND DRIVING METHOD THEREOF

CROSS-REFERENCE TO RELATED APPLICATION

This application claims priority from and the benefit of Korean Patent Application No. 10-2019-0068923 filed in the Korean Intellectual Property Office on Jun. 11, 2019, which is hereby incorporated by reference for all purposes as if fully set forth herein.

BACKGROUND

Field

Exemplary embodiments of the invention relate generally to a display device, and more specifically, to a display device and a driving method thereof for supplying a plurality of scan signals to a scan line during one frame.

Discussion of the Background

An organic light emitting diode display of the display device displays an image using an organic light emitting diode that generates light by recombination of electrons and holes. This has an advantage that it has a fast response speed and is driven with low power consumption.

A driving transistor included in a pixel has a hysteresis characteristic, in which a threshold voltage is shifted and a current changes depending on change of a gate voltage. Due to the hysteresis characteristic of the driving transistor, a current different from a current set in the pixel may flow according to a previous data voltage of the pixel. As such, the pixel may not generate light of desired luminance in a current frame.

To improve the hysteresis characteristic, a driving method supplying a plurality of scan signals (e.g., a scan signal having a plurality of scan pulses) corresponding to each pixel row may be applied.

The above information disclosed in this Background section is only for understanding of the background of the inventive concepts, and, therefore, it may contain information that does not constitute prior art.

SUMMARY

Display devices constructed according to exemplary embodiments of the invention and a driving method of the same are capable of varying the number of scan signals when driving with low power.

Additional features of the inventive concepts will be set forth in the description which follows, and in part will be apparent from the description, or may be learned by practice of the inventive concepts.

A display device according to an exemplary embodiment includes a display panel including a plurality of pixels connected to a p-type scan line, an n-type scan line, and a data line, and configured to display an image in a first mode driven by a first driving frequency or in a second mode driven by a second driving frequency lower than the first driving frequency, a first scan driver configured to supply a p-type scan signal having a first voltage to the p-type scan line, and a second scan driver configured to supply an n-type scan signal having a second voltage greater than the first voltage to the n-type scan line, in which the second mode includes a first period corresponding to one frame period and a second period including a plurality of consecutive frame periods, during the first period, the first scan driver is configured to supply i number of p-type scan signals to the p-type scan line, and the second scan driver is configured to supply i number of n-type scan signals to the n-type scan line, i being a natural number, and during at least one of the consecutive frame periods of the second period, the first scan driver is configured to supply j number of p-type scan signals to the p-type scan line, j being a natural number different from i.

The first scan driver may be configured to supply the j number of p-type scan signals to the p-type scan line in each of the frame periods of the second period.

A number of the p-type scan signal supplied during each of the frame periods of the second period may be less than a number of the p-type scan signal supplied during the first period.

The first scan driver may be configured to reduce a number of the p-type scan signal output in each of the frame periods of the second period as the second driving frequency decreases.

The second scan driver may be configured to not supply the n-type scan signal during the second period.

The first scan driver may be configured to supply the i number of p-type scan signals to the p-type scan line during one frame period in the first mode, and the second scan driver may be configured to supply the i number of the n-type scan signals to the n-type scan line during one frame period in the first mode.

The first scan driver and the second scan driver may be configured to simultaneously supply the p-type scan signal and the n-type scan signal to the p-type scan line and the n-type scan line during the first period, respectively.

The display device may further include a timing controller configured to supply the same number of start signals to the first scan driver and the second scan driver in the first mode, and supply a different number of start signals to the first scan driver and the second scan driver in the second mode.

The timing controller may be further configured to supply a first start signal having a first width to the first scan driver and a second start signal having the first width to the second scan driver, in response to the first period in the second mode.

The timing controller may be configured to supply the first start signal having a second width less than the first width to the first scan driver in response to the second period of the second mode.

The timing controller may be configured to reduce the second width of the first start signal as the second driving frequency decreases.

The timing controller may be configured to not supply the second start signal to the second scan driver in response to the second period of the second mode.

The display device may further include an emission driver configured to supply an emission control signal to an emission control line connected to each of the pixels to define an emission period and a non-emission period.

The display device may further include a data driver configured to supply a data signal to the data line.

Each of the pixels may include a light emitting element, a first transistor connected between a first node electrically connected to a first power supply and a second node electrically connected to a first electrode of the light emitting element, and configured to control a driving current, a second transistor connected between the data line and the first node, and configured to be turned on by the p-type scan signal supplied to a $k^{th}$ p-type scan line, $k^{th}$ being a natural number greater than 1, a third transistor connected between the second node and a third node connected to a gate electrode of the first transistor, and configured to be turned on by the n-type scan signal supplied to a $k^{th}$ n-type scan line, a fourth transistor connected between the third node and an initialization power supply, and configured to be turned on by the n-type scan signal supplied to a $(k-1)^{th}$ n-type scan line, a fifth transistor connected between the first power supply and the first node, and configured to be turned on by an emission control signal supplied to a k emission control line, a sixth transistor connected between the second node and the first electrode of the light emitting element, and configured to be turned on by the emission control signal, a seventh transistor connected between the initialization power supply and the first electrode of the light emitting element, and configured to be turned on by the p-type scan signal supplied to a $(k-1)^{th}$ n-type scan line, and a storage capacitor connected between the first power supply and the third node.

The first and second transistors may include p-type low-temperature poly-silicon (LTPS) thin film transistors, and the third and fourth transistors may include n-type oxide semiconductor thin film transistors.

A driving method of a display device including a plurality of pixels connected to a p-type scan line, an n-type scan line, and a data line, for displaying an image in a first mode driven by a first driving frequency or in a second mode driven by a second driving frequency lower than the first driving frequency, according to another exemplary embodiment includes the steps of, in a first period corresponding to one frame period, supplying i number of p-type scan signals to the p-type scan line, and i number of n-type scan signals to the n-type scan line, i being a natural number greater than 1, and supplying j number of p-type scan signals to the p-type scan line in each frame period in a second period including a plurality of consecutive frame periods, j being a natural number less than i, in which the first period and the second period are included in the second mode.

A number of the p-type scan signal supplied during each of the frame periods of the second period may be decreased as the second driving frequency decreases.

The driving method may further include supplying the i number of the p-type scan signals to the p-type scan line and the i number of the n-type scan signals to the n-type scan line in each frame period included in the first mode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION OF THE EMBODIMENTS

Figure 1:
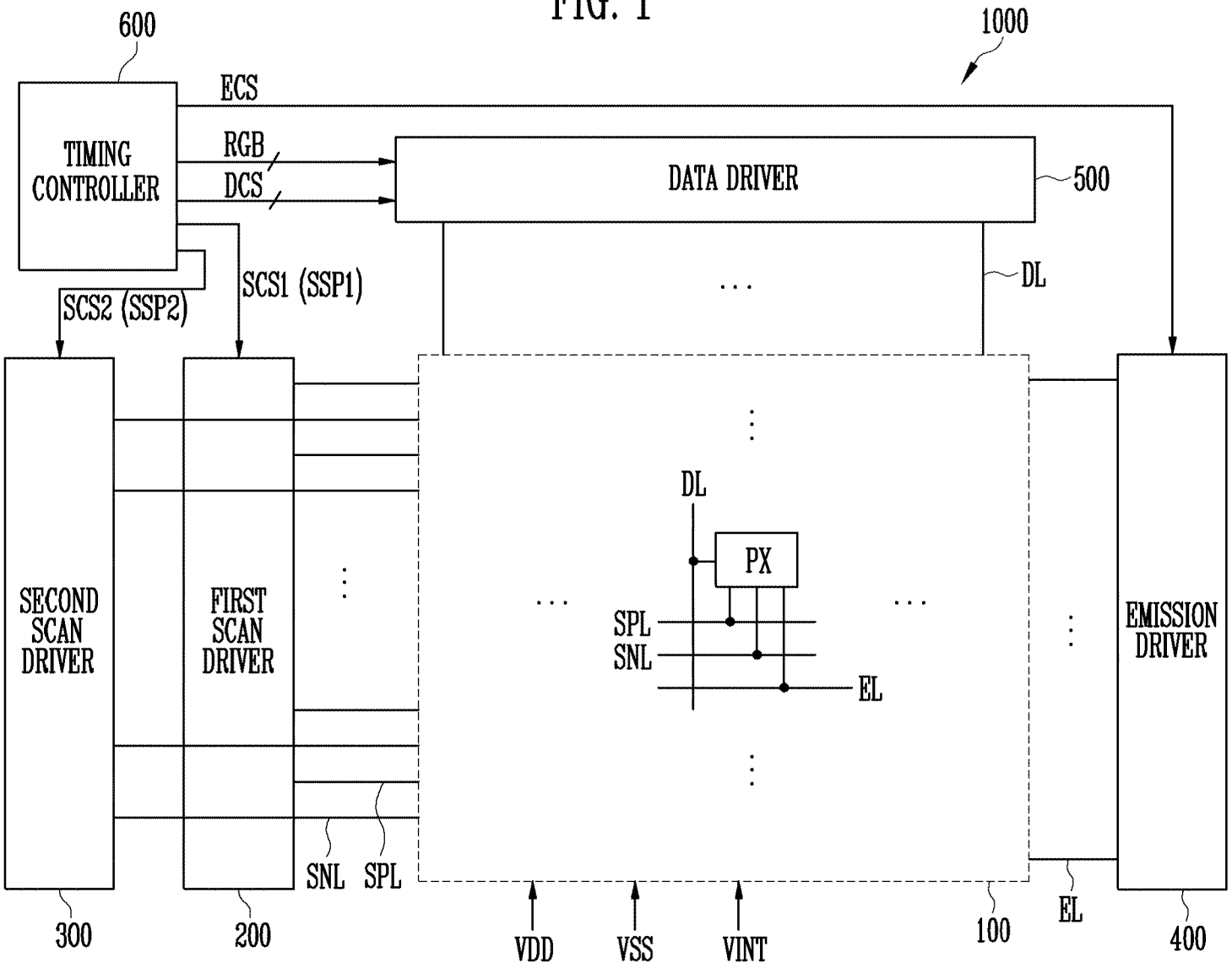
FIG. 1 is a block diagram of a display device according to an exemplary embodiment.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As is customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a block diagram of a display device according to an exemplary embodiment.

Referring to FIG. 1, a display device 1000 may include a display panel 100, a first scan driver 200, a second scan driver 300, an emission driver 400, a data driver 500, and a timing controller 600.

In an exemplary embodiment, the display device 1000 may further include a power supply unit for supplying a first power supply VDD, a second power supply VSS, and an initialization power supply VINT to the display panel 100. However, the inventive concepts are not limited thereto, and in some exemplary embodiments, and at least one of the first power supply VDD, the second power supply VSS, and the initialization power supply VINT may be supplied from the timing controller 600 or the data driver 500.

In an exemplary embodiment, the display device 1000 may be operated in at least one of a first mode (e.g., a normal driving mode) and a second mode (e.g., a low power driving mode). The first mode is a driving mode, in which the display panel 100 normally displays an input image data. For example, in the first mode, a general image or motion picture may be displayed by a user's command input, and the like.

On the other hand, the second mode is a mode (e.g., always-on-display (AOD) mode), in which simple display information is always displayed when the display device 1000 is in a standby state.

In the first mode, the image may be displayed at a first driving frequency. In the second mode, the image may be displayed at a second driving frequency lower than the first driving frequency. For example, the first driving frequency may be set to about 60 Hz or more, and the second driving frequency may be set to about 50 Hz or less (e.g., about 1 Hz).

The display panel 100 may include a plurality of p-type scan lines SPL, a plurality of n-type scan lines SNL, a plurality of emission control lines EL, a plurality of data lines DL, and a plurality of pixel PX connected to each of the p-type scan lines SPL, n-type scan lines SNL, emission control lines EL, and the data lines DL. Each of the pixels PX may include a driving transistor and a plurality of switching transistors.

The p-type scan lines SPL and the n-type scan lines SNL are distinguished to describe scan lines connected to different elements in the pixel PX, and may not limit functions of scan lines and scan signals.

The pixel PX is illustrated as being connected to one p-type scan line SPL, one n-type scan line SNL, one data line DL, and one emission control line EL in FIG. 1, however, the inventive concepts are not limited thereto. In some exemplary embodiments, signal lines connected to the pixel PX corresponding to a circuit structure of the pixel PX may be set variously.

A first scan driver 200 may sequentially supply a p-type scan signal to the pixel PX through the p-type scan lines SPL based on a first control signal SCS1. The first scan driver 200 may receive the first control signal SCS1 from the timing controller 600. The first control signal SCS1 may include a first start signal SSP1 and at least one clock signal. The number of the p-type scan signals may be determined by a pulse width of the first start signal SSP1.

In an exemplary embodiment, a plurality of p-type scan signals (e.g., a plurality of scan pulses) may be supplied to one p-type scan line SPL during one frame period. The p-type scan signal may have a first voltage. The first voltage may be a logic low-level voltage that turns on the p-type transistor.

In an exemplary embodiment, the first scan driver 200 may include stages dependently connected to each other to sequentially output the p-type scan signal to the p-type scan lines SPL.

The second scan driver 300 may sequentially supply an n-type scan signal to the pixels PX through the n-type scan lines SNL based on a second control signal SCS2. The second scan driver 300 may receive the second control signal SCS2 from the timing controller 600. The second control signal SCS2 may include a second start signal SSP2 and at least one clock signal. The number of n-type scan signals may be determined by a pulse width of the second start signal SSP2.

In an exemplary embodiment, a plurality of n-type scan signals (e.g., a plurality of scan pulses) may be supplied to one n-type scan line SNL during one frame period. The n-type scan signal may have a second voltage greater than the first voltage. The second voltage may be a logic high-level voltage that turns on an n-type transistor.

In an exemplary embodiment, the second scan driver 300 may include stages dependently connected to each other to sequentially output the n-type scan signal to the n-type scan lines SNL.

The first and second scan drivers 200 and 300 may control the p-type scan signal supplied to the p-type scan lines SPL in response to a driving frequency. Likewise, the second scan driver 300 may control the n-type scan signal supplied to the n-type scan lines SNL in response to the driving frequency.

For example, in the first mode, the p-type scan signal supplied to the p-type scan line SPL and the n-type scan signal supplied to the n-type scan line SNL may be repeatedly supplied every predetermined cycle.

In the second mode, the p-type scan signal supplied to the p-type scan lines SPL may be repeatedly supplied every predetermined cycle, and the n-type scan signal supplied to the n-type scan lines SNL may not be supplied during a predetermined period. In addition, the number of p-type scan signals supplied to the second mode may be different from the number of p-type scan signals supplied to the first mode.

The emission driver 400 may sequentially supply emission control signals to the pixels PX through emission control lines EL based on a third control signal ECS. The emission driver 400 receives the third control signal ECS and a clock signal from the timing controller 600. The emission control signal may divide one frame period into an emission period and a non-emission period for pixel lines.

The data driver 500 may receive a fourth control signal DCS and an image data signal RGB from the timing controller 600. The data driver 500 may supply a data signal (or data voltage) to the pixels PX through the data lines DL based on the fourth control signal DCS and the image data signal RGB. In an exemplary embodiment, the data driver 500 may supply a data signal corresponding to a grayscale of an image to the data lines DL, or may supply a predetermined reference voltage according to the driving mode of the display device 1000.

The timing controller 600 may control a driving of the first scan driver 200, the second scan driver 300, the emission driver 400, and the data driver 500 based on timing signals supplied from the outside. The timing controller 600 may supply the first scan signal SCS1 including the first start signal SSP1 and the scan clock signals to the first scan driver 200, and may supply the second scan signal SCS2 including the second start signal SSP2 and the scan clock signals to the second scan driver 300. In addition, the timing controller 600 may supply the third control signal ECS and an emission control clock signal to the emission driver 400. The fourth control signal DCS controlling the data driver 500 may include a source start signal, a source output enable signal, a source sampling clock, and the like.

The scan drivers 200 and 300 and the emission driver 400 according to the illustrated exemplary embodiment are shown as separate elements as shown in FIG. 1, however, the inventive concepts are not limited thereto. For example, in some exemplary embodiments, the scan drivers 200 and 300 and the emission driver 400 may be formed of a single driver.

The scan drivers 200 and 300 and the emission driver 400 may be mounted on a substrate through a thin film process. In addition, the scan drivers 200 and 300 and/or the emission driver 400 may be disposed on both sides of a pixel area including the pixels PX.

Figure 2:
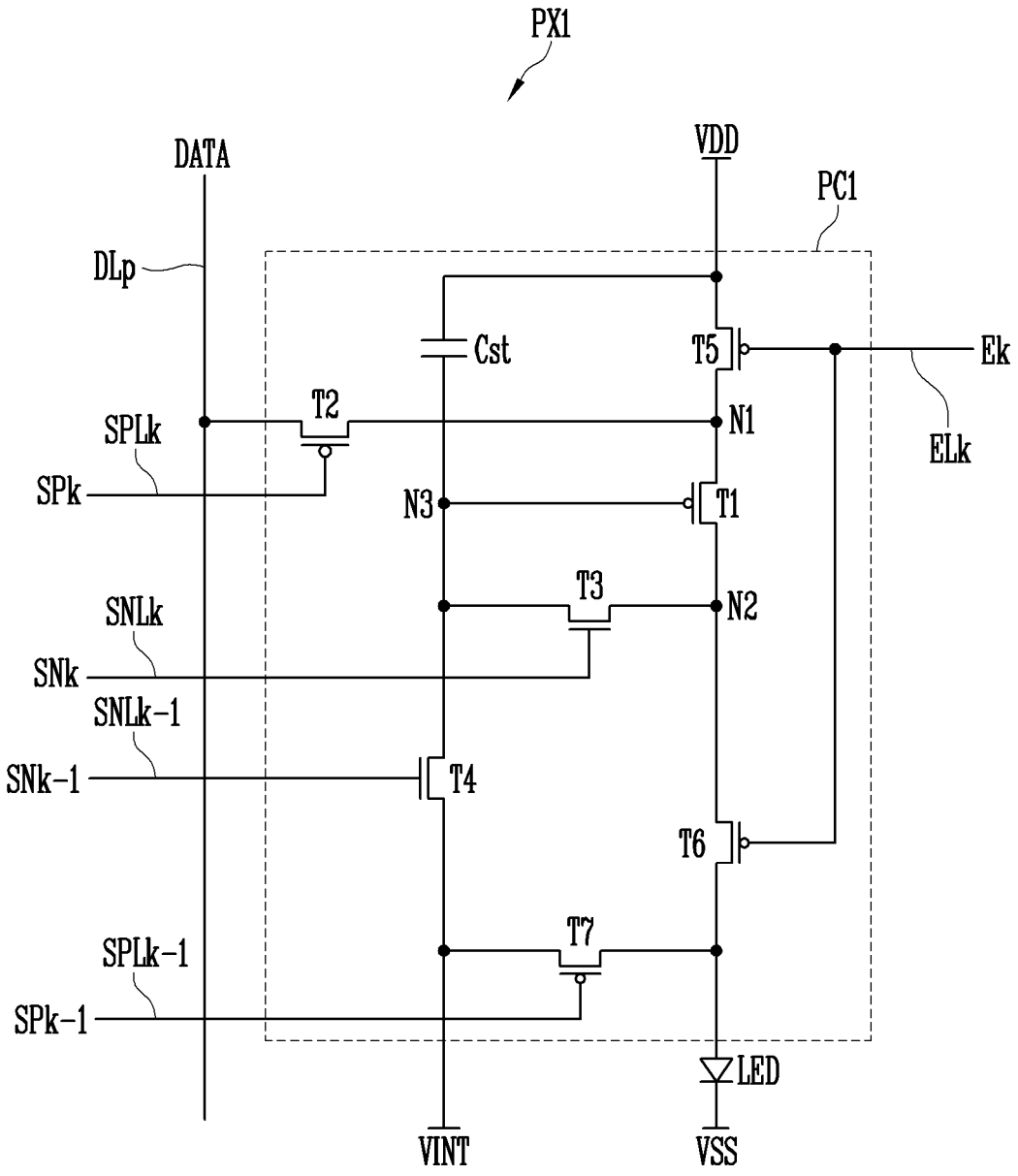
FIG. 2 is an exemplarily circuit diagram of a pixel included in a display device of FIG. 1.

FIG. 2 is an exemplary circuit diagram of a pixel included in a display device of FIG. 1.

FIG. 2 exemplarily shows a pixel PX1 disposed at a $k^{th}$ row and a $p^{th}$ column, in which "k" and "p" are natural numbers.

Referring to FIG. 2, the pixel PX1 may include a light emitting element LED and a pixel circuit PC1 connected thereto.

A first electrode of the light emitting element LED may be connected to the pixel circuit PC1, and a second electrode of the light emitting element LED may be connected to the second power supply VSS. The light emitting element LED may generate light of a predetermined luminance corresponding to an amount of current supplied from the pixel circuit PC1. The first electrode may be the anode and the second electrode may be the cathode. Alternatively, the first electrode may be the cathode and the second electrode may be the anode.

The pixel circuit PC1 controls an amount of current flowing from the first power supply VDD to the second power supply VSS via the light emitting element LED in response to a data voltage DATA. The pixel circuit PC according to the illustrated exemplary embodiment may include first to seventh transistors T1 to T7 and a storage capacitor Cst.

The first transistor T1 may be connected between a first node N1 electrically connected to the first power supply VDD, and a second node N2 electrically connected to the first electrode of the light emitting element LED. The first transistor T1 may generate a driving current and provide it to the light emitting element LED. A gate electrode of the first transistor T1 may be connected to the third node N3. The first transistor T1 may function as a driving transistor for the pixel PX1.

The second transistor T2 may be connected between a $p^{th}$ data line DLp and the first node N1. The second transistor T2 may include a gate electrode receiving a $k^{th}$ p-type scan signal SPk. The $k^{th}$ p-type scan signal SPk may be supplied through a $k^{th}$ p-type scan line SPLk. When the second transistor T2 is turned on, the data voltage DATA may be transferred to the first node N1.

The third transistor T3 may be connected between the second node N2 and the third node N3. The third transistor T3 may include a gate electrode receiving the $k^{th}$ n-type scan signal SNk. The $k^{th}$ n-type scan signal SNk may be supplied through a $k^{th}$ n-type scan line SNLk. The third transistor T3 may be turned on by the $k^{th}$ n-type scan signal SNk to electrically connect the second electrode of the first transistor T1 and the third node N3. As such, when the third transistor T3 is turned on, the first transistor T1 may be connected in a diode form. In particular, the third transistor T3 may perform writing of the data voltage DATA and compensation of a threshold voltage for the first transistor T1.

The storage capacitor Cst is connected between the first power supply VDD and the third node N3. The storage capacitor Cst may store a voltage corresponding to the data voltage DATA and the threshold voltage of the first transistor T1.

The fourth transistor T4 may be connected between the third node N3 and the initialization power supply VINT. The fourth transistor T4 may include a gate electrode receiving a $k-1^{th}$ n-type scan signal SNk-1. The $k-1^{th}$ n-type scan signal SNk-1 may be supplied through the $k-1^{th}$ n-type scan line SNLk-1.

The fourth transistor T4 may be turned on by the $k-1^{th}$ n-type scan signal SNk-1 to supply a voltage of the initialization power supply VINT to the third node N3. As such, a voltage of the third node N3, that is, a gate voltage of the first transistor T1, may be initialized to the voltage of the initialization power supply VINT. In an exemplary embodiment, the initialization power supply VINT may be set to a lower voltage than the lowest voltage of the data voltage.

The fifth transistor T5 may be connected between the first power supply VDD and the first node N1. The fifth transistor T5 may include a gate electrode receiving a $k^{th}$ emission control signal Ek.

The sixth transistor T6 may be connected between the second node N2 and the first electrode of the light emitting element LED. The sixth transistor T6 may include a gate electrode receiving the $k^{th}$ emission control signal Ek.

The fifth and sixth transistors T5 and T6 may be turned on during the gate-on period (e.g., a period of logic low-level) of the $k^{th}$ emission control signal Ek, and may be turned off during the gate-off period of the $k^{th}$ emission control signal Ek.

The seventh transistor T7 may be connected between the initialization power supply VINT and the first electrode of the light emitting element LED. The seventh transistor T7 may include a gate electrode receiving the $k-1^{th}$ p-type scan signal SPk-1. The $k-1^{th}$ n-type scan signal SNk-1 may be supplied through the $k-1^{th}$ p-type scan line SPLk-1. In some exemplary embodiments, however, a gate electrode of the seventh transistor T7 may be connected to the $k^{th}$ p-type scan line SPLk or a k+1t p-type scan line.

The seventh transistor T7 may be turned on to supply the voltage of the initialization power supply VINT to the first electrode of the light emitting element LED.

In an exemplary embodiment, initialization power supplies having different voltage levels may be connected to the fourth transistor T4 and seventh transistor T7, respectively. For example, a first initialization power supply may be connected to one electrode of the fourth transistor T4, and a second initialization power supply may be connected to one electrode of the seventh transistor T7.

In an exemplary embodiment, the first, second, and seventh transistors T1, T2, and T7 may be a p-type low-temperature poly-silicon (LTPS) thin film transistor, and the third and fourth transistors T3 and T4 may be n-type oxide semiconductor thin film transistor. Since the n-type oxide semiconductor thin film transistor is superior to the p-type LTPS thin film transistor in terms of current leakage characteristics (or off-current characteristics), the third and fourth transistors T3 and T4, which are switching transistors, may be formed of the n-type oxide semiconductor thin film transistor.

As such, leakage currents in the third and fourth transistors T3 and T4 may be greatly reduced, thereby driving a pixel and displaying an image at a low frequency of less than 30 Hz. In this manner, power consumption in the first mode may be reduced.

In an exemplary embodiment, the fifth and sixth transistors T5 and T6 may be the p-type LTPS thin film transistors.

Hereinafter, a driving method of a display device including the pixel PX1 shown in FIG. 2 will be described in more detail.

Figure 3:
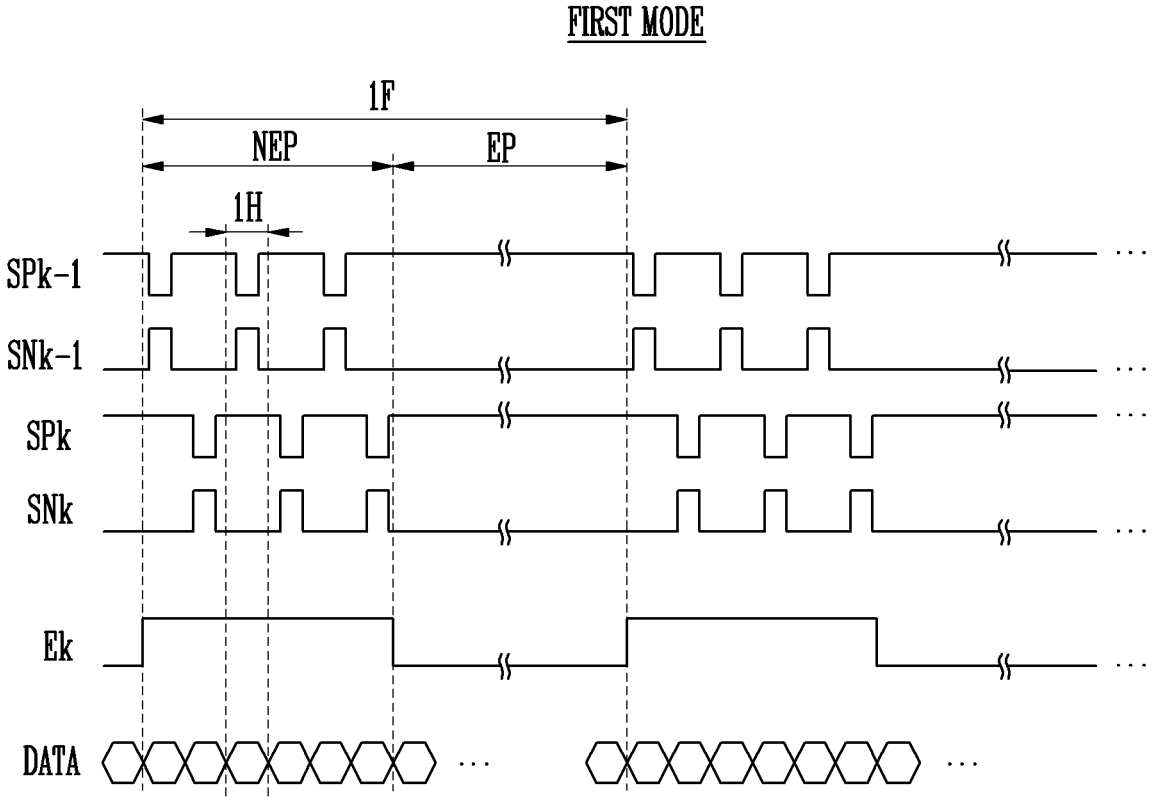
FIG. 3 is a timing diagram exemplarily illustrating driving a display device of FIG. 1 in a first mode.

FIG. 3 is a timing diagram exemplarily illustrating driving a display device of FIG. 1 in a first mode.

Referring to FIGS. 1 to 3, the display device 1000 may operate in the first mode.

FIG. 3 shows an example of signals supplied to the pixel PX1 included in the $k^{th}$ pixel row in the first mode. In the first mode, the scan signals SPk-1, SPk, SNk-1, and SNk and the emission control signal Ek may be supplied to the display panel 100 at the same frequency at every frame period. One frame period 1F may include an emission period EP and a non-emission period NEP.

In FIG. 3, lengths of the emission period EP and the non-emission period NEP included in one frame period are shown to be similar to each other, however, the length of the emission period EP may be longer than the length of the non-emission period NEP.

Since the second and seventh transistors T2 and T7 are p-type LTPS transistors, the p-type scan signal SPk-1 and SPk may be supplied to the second and seventh transistors T2 and T7.

Since the third and fourth transistors T3 and T4 are n-type oxide semiconductor thin film transistors, the n-type scan signal SNk-1 and SNk may be supplied to the third and fourth transistors T3 and T4.

In an exemplary embodiment, three p-type scan signals SPk-1 and SPk and three n-type scan signals SNk-1 and SNk may be supplied to the pixel PX1 during the non-emission period NEP in the first mode. More particularly, each of the p-type scan signals SPk-1 and SPk and each of the n-type scan signals SNk-1 and SNk may be supplied to the pixel PX1 three times during the non-emission period NEP.

The $k^{th}$ p-type scan signal SPk may be a signal, in which the $k-1^{th}$ p-type scan signal SPk-1 is shifted by one horizontal period 1H. The $k-1^{th}$ p-type scan signal SPk-1 and the $k^{th}$ p-type scan signal SPk do not overlap each other.

In an exemplary embodiment, in the first mode, the $k^{th}$ n-type scan signal SNk may be supplied simultaneously with the $k^{th}$ p-type scan signal SPk. In the first mode, the $k-1^{th}$ n-type scan signal SNk-1 may be supplied simultaneously with the $k-1^{th}$ p-type scan signal SPk-1.

The gate voltage of the first transistor T1 may be initialized and the first transistor T1 may be in on-bias state, in response to each of the first and second signals of the $k-1^{th}$ n-type scan signal SNk-1. In addition, the first transistor T1 may be in an off-bias state, in response to each of the first and second signals of the $k^{th}$ n-type scan signal SNk and the $k^{th}$ p-type scan signal SPk.

More particularly, the gate voltage (and gate-source voltage) of the first transistor T1 is repeatedly changed, so that hysteresis change of the first transistor T1 depending on a difference between a data voltage of the previous frame and a data voltage of the current frame may be reduced.

Then, the gate voltage of the first transistor T1 may be re-initialized by the third signal of the $k-1^{th}$ n-type scan signal SNk-1, and the data voltage DATA corresponding to a timing of the third signal of the $k^{th}$ p-type scan signal SPk may be stored in the storage capacitor Cst by the third signal of the $k^{th}$ n-type scan signal SNk and the third signal of the $k^{th}$ p-type scan signal SPk.

Then, the pixel PX1 may emit light in a grayscale corresponding to the data voltage DATA stored in the storage capacitor Cst during the emission period EP.

The $k-1^{th}$ p-type scan signal SPk-1 is independent of a bias state of the first transistor T1. For example, the anode (e.g., first electrode) of the light emitting element may be initialized in response to the $k-1^{th}$ p-type scan signal SPk-1.

As such, in the first mode, the on-bias state and the off-bias state of the first transistor T1 may be repeated during one frame period, thereby reducing a hysteresis variation of the first transistor T1 and improving an instant after-image when a luminance variation is greater.

However, an operation of the first mode increases the power consumption since the scan signals are output multiple times during one frame. Therefore, when the display device 1000 displays a standby image, a low-grayscale image, a still image, and the like, the power consumption should be reduced by lowering the driving frequency, for example.

Figure 4:
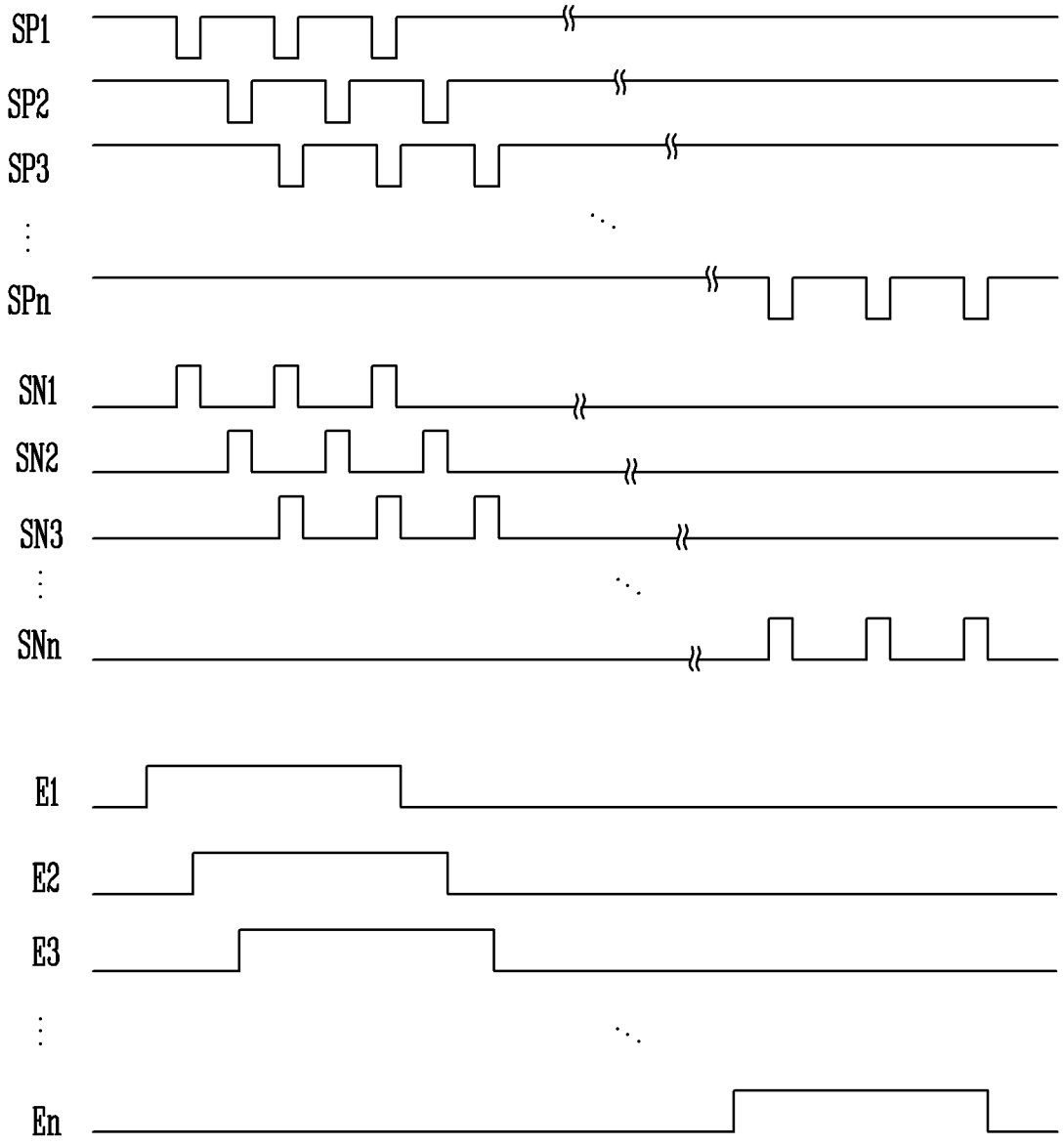
FIG. 4 is a timing diagram exemplarily illustrating driving a display device of FIG. 1 in a first mode.

FIG. 4 is a timing diagram exemplarily illustrating driving a display device of FIG. 1 in a first mode.

Hereinafter, the first drive frequency of the first mode will be exemplarily described as 60 Hz. However, the inventive concepts are not limited thereto, and in some exemplary embodiments, the first driving frequency may be variously set, such as 120 Hz.

Referring to FIGS. 3 and 4, the p-type scan signals SP1 to SPn ("n" is a natural number greater than 1) may be sequentially supplied, and simultaneously the n-type scan signals SN1 to SNn may be sequentially supplied during a predetermined unit period (or unit frame period) in the first mode. The unit period may be repeated by a number of times (e.g., 60 times) corresponding to the first driving frequency for a unit time (e.g., about 1 second). For example, an image of 60 frames may be displayed by the first driving frequency.

The $k^{th}$ p-type scan signal SPk may overlap with the $k^{th}$ n-type scan signal SNk.

The emission control signals E1 to En may be supplied sequentially, and may be supplied repeatedly with the unit period as a cycle.

In the first mode, the data voltage may be stored in pixels PX1 every frame.

Figure 5:
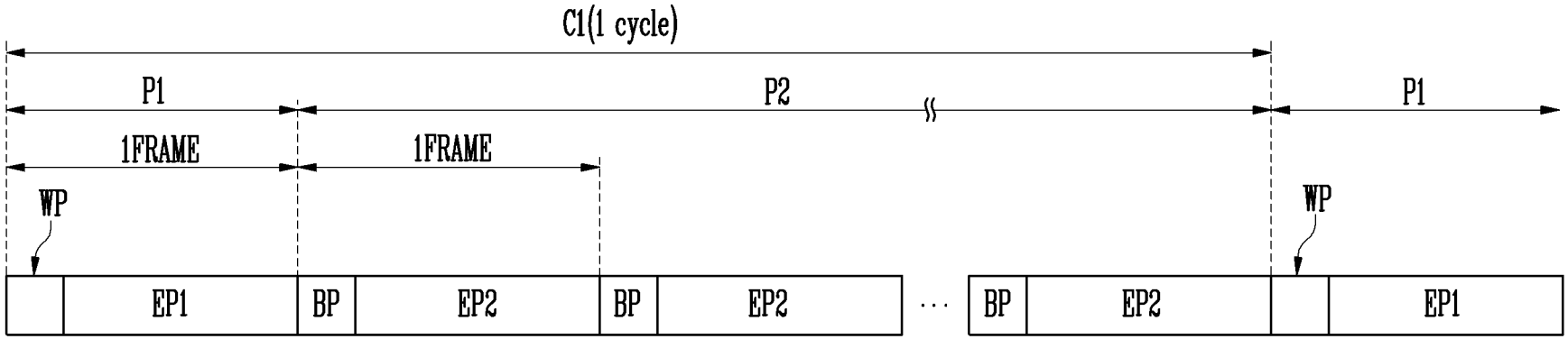
FIG. 5 is a timing diagram exemplarily illustrating driving a display device of FIG. 1 in a second mode.

FIG. 5 is a timing diagram exemplarily illustrating driving a display device of FIG. 1 in a second mode.

Referring to FIGS. 1, 2 and 5, the display device 1000 may operate in the second mode.

FIG. 5 schematically shows how the pixel PX1 included in the $k^{th}$ pixel row is driven in the second mode. The second mode may be driven by the second driving frequency. The second driving frequency is lower than the first driving frequency. For example, the second driving frequency may be about 1 Hz.

As shown in FIG. 5, in the second mode, the display device 1000 may operate with a first cycle C1 including a first period P1 corresponding to one frame period 1F and a second period P2 including a plurality of consecutive frame periods. In the second mode, a supply of scan signals SPk and SNk may be repeated with a cycle of the first cycle C1.

The first period P1 may include a data writing period WP and a first emission period EP1. Each frame period of the second period P2 may include a bias period BP and a second emission period EP2.

The data writing period WP is a period, during which the second and third transistors T2 and T3 are turned on and the data voltage DATA is stored in the storage capacitor Cst. The bias period BP is a period, during which only the second transistor T2 is turned on and a predetermined voltage is supplied to the source electrode of the first transistor T1 to supply (or maintain) an on-bias to the first transistor T1. As such, the first period P1 may be also be referred to as a writing period and the second period P2 may also be referred to as a holding period.

In the second mode, during the first cycle C1, the pixel PX1 may emit light at a grayscale substantially corresponding to the data voltage DATA written in the data writing period WP. For example, the first cycle C1 may include 60 frame periods. In this case, the second period P2 may have 59 frame periods. More particularly, the pixel PX1 may emit light during 60 frame periods based on the data voltage DATA written in the data writing period WP of one frame period.

In an exemplary embodiment, during the second period P2, only the p-type scan signal is supplied to supply an on-bias to the first transistor T1 and to initialize a voltage of the anode of the light emitting element LED, and the n-type scan signal is not supplied. Therefore, power consumption for supplying scan signals may be reduced. For example, when the p-type scan signal is supplied at 60 Hz, the n-type scan signal may be supplied at 1 Hz in the second mode.

On the other hand, during the second period P2 in the second mode, there is substantially no write operation of the data voltage. Therefore, the power consumption in the second mode may be further reduced by controlling the number of the p-type scan signal supplied during the bias period BP.

The display device 1000 according to an exemplary embodiment may change the number of the p-type scan signals supplied to the first period P1 and the second period P2 in the second mode to be less than the number of the p-type scan signals supplied to the first period P1 and one frame in the first mode, thereby improving power consumption.

Figure 6:
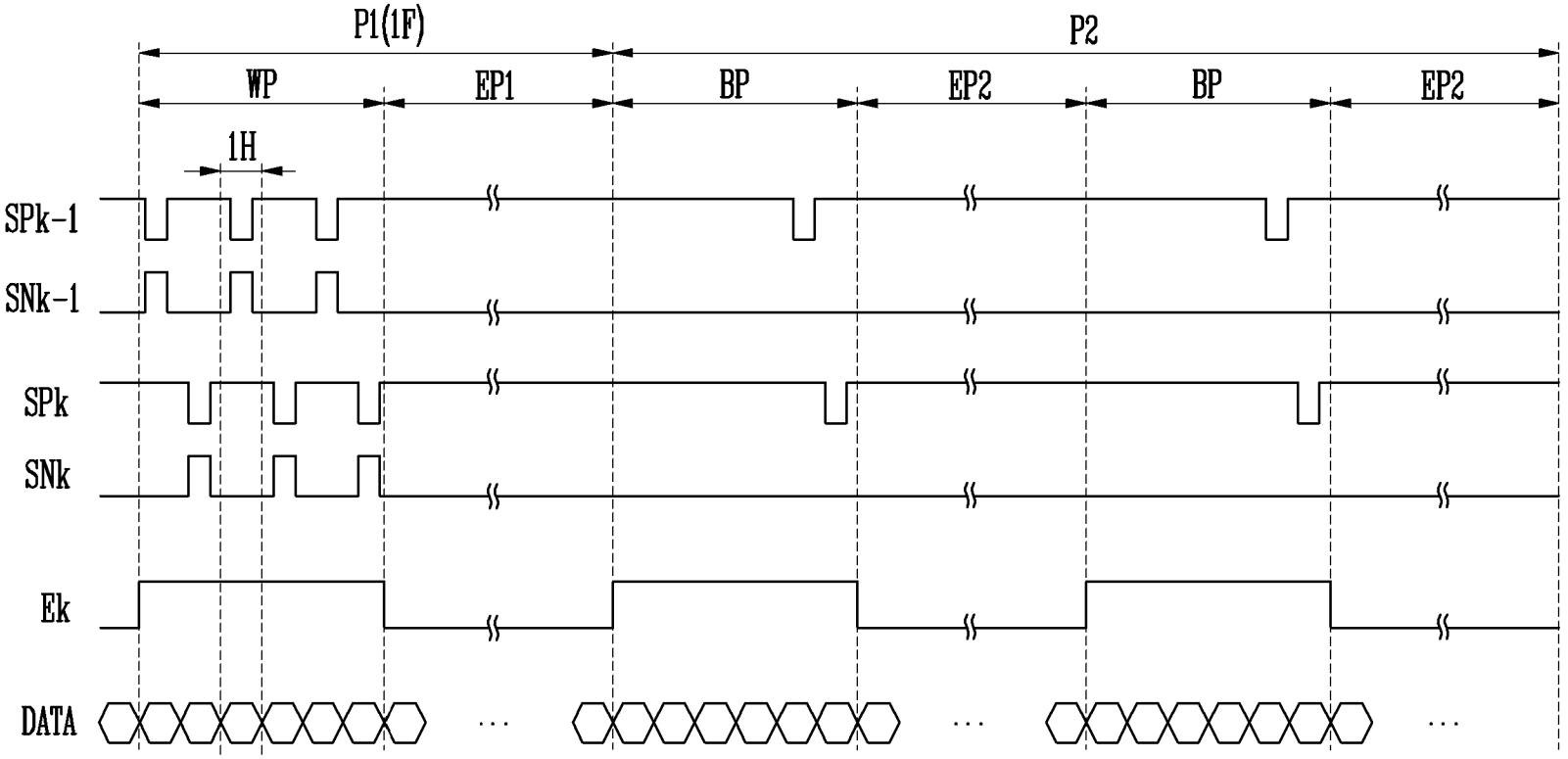
FIG. 6 is a timing diagram exemplarily illustrating driving a display device of FIG. 1 in a second mode.

FIG. 6 is a timing diagram exemplarily illustrating driving a display device of FIG. 1 in a second mode.

Referring to FIGS. 1, 2, 5, and 6, in the second mode, the first period P1 including the data writing period WP and the first emission period EP1, and the second period P2 including a plurality of consecutive frame periods may be repeated.

In FIG. 6, lengths of the emission periods EP1 and EP2, the writing period WP, and the bias period BP included in one frame period may be shown to be similar to each other, however, the length of each of the emission periods EP1 and EP2 may be longer than the length of each of the writing period WP and the bias period BP.

During the first period P1, "i" number of ("i" is a natural number greater than 1) $k-1^{th}$ p-type scan signals SPk-1 and "i" number of $k^{th}$ p-type scan signals SPk may be supplied to the $k-1^{th}$ p-type scan line SPLk-1 and the $k^{th}$ p-type scan line SPLk, respectively. In addition, during the first period, "i" number of $k-1^{th}$ n-type scan signals SNk-1 and "i" number of $k^{th}$ n-type scan signals SNk may be supplied to $k-1^{th}$ n-type scan lines SNLk-1 and $k^{th}$ n-type scan lines SNLk, respectively. The $k^{th}$ p-type scan signal SPk and the $k^{th}$ n-type scan signal SNk may be supplied simultaneously. For example, three p-type scan signals SPk-1 and SPk and three n-type scan signals SNk-1 and SNk may be supplied during the first period P1.

As such, the operation of the pixel PX1 during the first period P1 may be substantially the same as the operation of the pixel PX1 during the non-emission period NEP (see FIG. 3) in the first mode. The pixel PX1 may emit light in the luminance corresponding to the data voltage DATA supplied during the writing period WP of the first cycle C1.

Each of the frame periods included in the second period P2 may include a bias period BP and a second emission period EP2. The n-type scan signals SNk-1 and SNk are not supplied during the second period P2. As such, the third and fourth transistors T3 and T4 may maintain a turn-off state during the second period P2.

During the bias period, "j" number of $k-1^{th}$ p-type scan signals SPk-1 and "j" number of $k^{th}$ p-type scan signals SPk may be supplied to the $k-1^{th}$ p-type scan line SPLk−1 and $k^{th}$ p-type scan line SPLk, respectively, in which "j" is a natural number of 1 or greater. In an exemplary embodiment, the number of p-type scan signals SPk-1 and SPk supplied during the bias period BP may be less than the number of p-type scan signals SPk-1 and SPk supplied during the write period of the first period P1. For example, one p-type scan signal SPk-1 and one p-type scan signal SPk may be supplied during the bias period BP.

The seventh transistor T7 may be turned on and a voltage of the node of the light emitting element LED may be initialized in response to the $k-1^{th}$ p-type scan signal SPk-1 during the bias period BP. In addition, the second transistor T2 may be turned on and a predetermined data voltage DATA may be supplied to the first node N1 (e.g., the source electrode of the first transistor T1) in response to the $k^{th}$ p-type scan signal SPk during the bias period BP More particularly, an on-bias may be supplied to the first transistor T1 during the bias period BP. As such, in the second mode, in which a data writing is intermittently performed, image defects, such as a flicker and the like, may be prevented or at least be suppressed.

In an exemplary embodiment, the data voltage DATA supplied during the second period P2 may be the same as the data voltage DATA supplied during the first period P1. In another exemplary embodiment, a predetermined reference voltage may be supplied to each of the data lines DL during the second period P2. In particular, a predetermined reference voltage may be supplied through data lines DL to apply an on-bias to the first transistor T1 during the second period P2. For example, the reference voltage may be a voltage corresponding to a black grayscale.

A load on the entire display apparatus 1000 may be generated by the p-type scan signals SPk-1 and SPk supplied during the bias period BP. For example, power may be consumed from a load that may be generated due to toggling for generating the p-type scan signals SPk-1 and SPk, a load on a signal line due to a turn-on of a transistor by the p-type scan signals SPk-1 and SPk, and the like.

As described above, a display device according to an exemplary embodiment may initialize an anode, and apply an on-bias to a first transistor during a bias period in a second mode, thereby improving a flicker that may otherwise occur from low frequency driving of 20 Hz or less (e.g., 1 Hz). In addition, the number of p-type scan signals SPk-1 and SPk supplied during a bias period BP is set to be less than the number of p-type scan signals supplied during one frame and/or a write period WP in a first mode, thereby preventing an increase in load due to toggling for generating p-type scan signals SPk-1 and SPk and further reducing power consumption in the second mode.

Figure 7A:
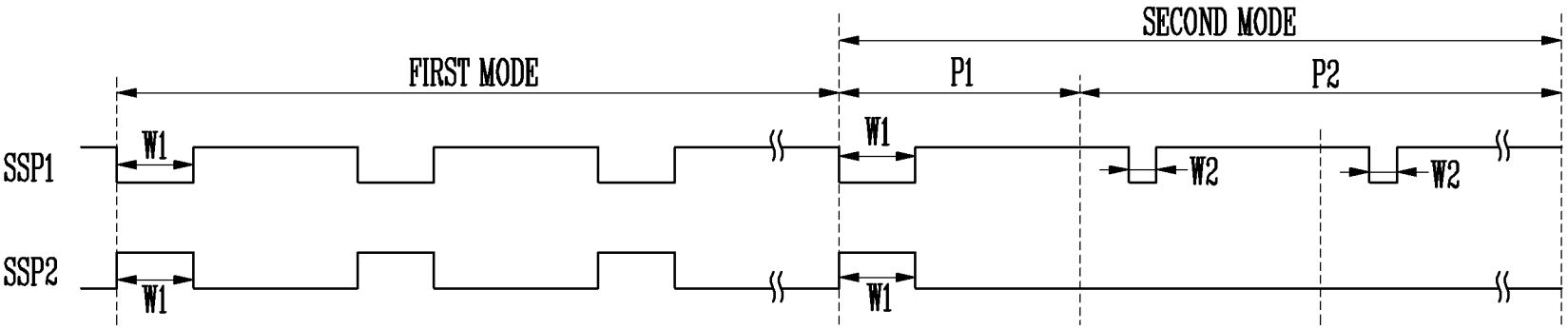
FIG. 7A is a timing diagram exemplarily illustrating start signals output in a first mode and a second mode of a display device of FIG. 1.
Figure 7B:
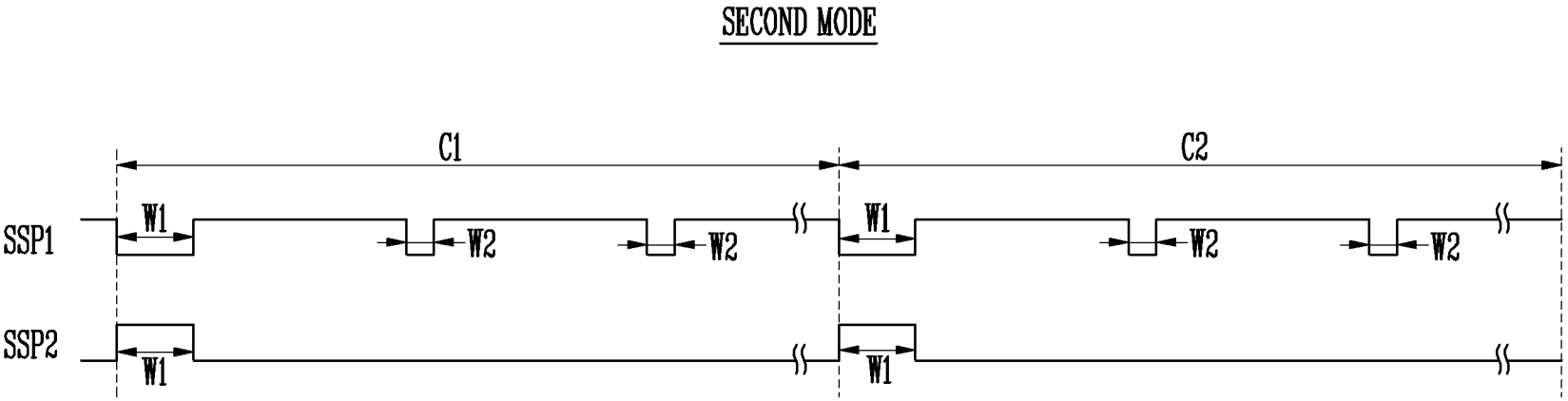
FIG. 7B is a timing diagram exemplarily illustrating start signals output in a second mode of a display device of FIG. 1.

FIG. 7A is a timing diagram exemplarily illustrating start signals output in a first mode and a second mode of a display device of FIG. 1, and FIG. 7B is a timing diagram exemplarily illustrating start signals output in a second mode of a display device shown in FIG. 1.

Referring to FIGS. 1, 7A and 7B, the timing controller 600 may supply the first start signal SSP1 to the first scan driver 200, and may supply the second start signal SSP2 to the second scan driver 300.

In an exemplary embodiment, the number of the $p^{th}$ scan signals (or the number of toggling) may be determined in accordance with a pulse width of the first start signal SSP1. Similarly, the number of the $n^{th}$ scan signals (or the number of toggling) may be determined in accordance with a pulse width of the second start signal SSP2.

The first start signal SSP1 corresponds to a logic low-level. In particular, the $p^{th}$ scan signal may be generated corresponding to a logic low-level period of the first start signal SSP1.

The second start signal SSP2 corresponds to a logic high-level. In particular, the $n^{th}$ scan signal may be generated corresponding to a logic high-level period of the second start signal SSP2.

In the first mode, the timing controller 600 may supply the first start signal SSP1 having a first width W1 to the first scan driver 200 corresponding to each frame period. In addition, in the first mode, the timing controller 600 may supply the second start signal SSP2 having a first width W1 to the second scan driver 300 corresponding to each frame period.

In response to the first period P1 in the second mode, the timing controller 600 may supply the first start signal SSP1 having the first width W1 to the first scan driver 200 and may supply the second start signal SSP2 having the first width W1 to the second scan driver 300. Accordingly, the number of p-type scan signals and the number of n-type scan signals (or the number of toggling) supplied to one frame and the first period P1 in the first mode may be the same.

In response to the second period P2 in the second mode, the timing controller 600 may supply the first start signal SSP1 having the second width W2 to the first scan driver 300. In this case, the second width W2 may be less than the first width W1. Since the second width W2 is less than the first width W1, the number of p-type scan signals supplied to the pixel PX1 during each bias period of the second period P2 may be less than the number of p-type scan signals supplied during the writing period WP of the first period P.

On the other hand, the timing controller 600 may stop the supply of the second start signal SSP2 during the second period P2 in the second mode.

As shown in FIG. 7B, the first cycle C1 may be repeated in the second mode. For example, the first start signal SSP1 may be generated at a driving frequency of 60 Hz and the second start signal SSP2 may be generated at a driving frequency of 1 Hz in the second mode. In particular, the first cycle C1 may include 60 frame periods.

Figure 8A:
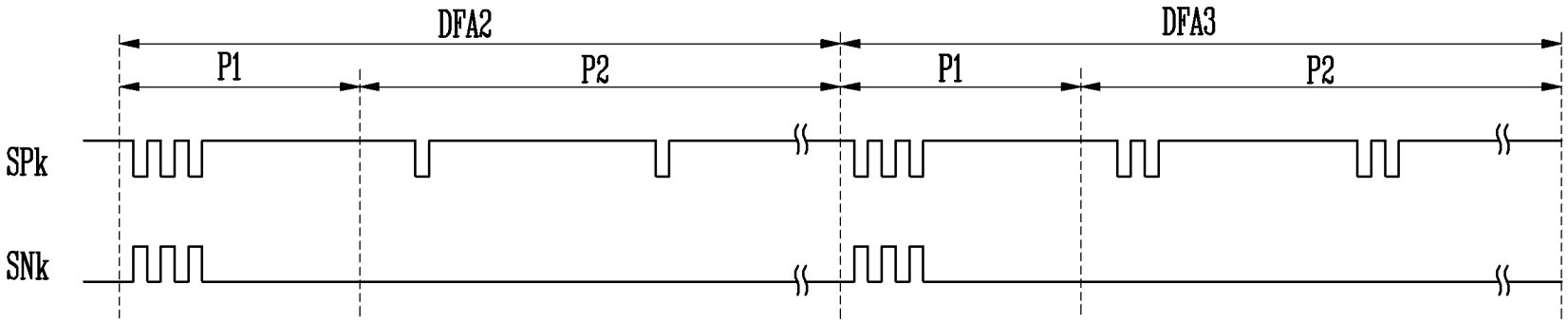
FIG. 8A is a timing diagram exemplarily illustrating scan signals output in a second mode of a display device of FIG. 1.
Figure 8B:
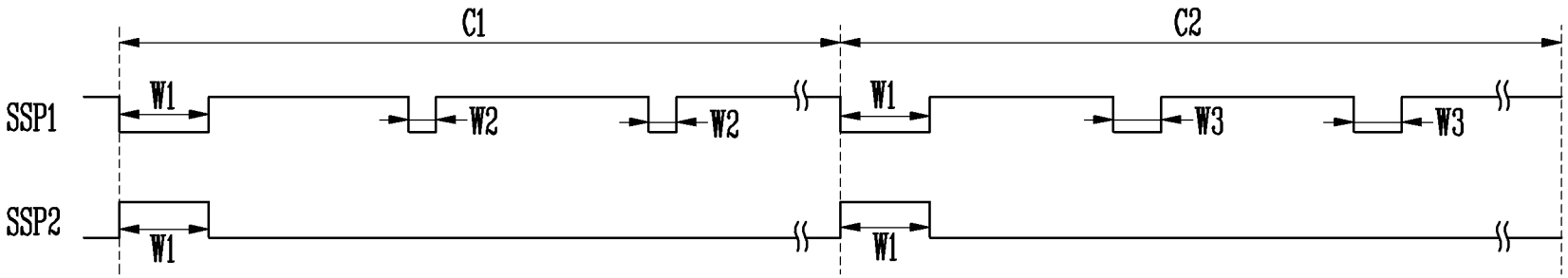
FIG. 8B is a timing diagram exemplarily illustrating start signals corresponding to scan signals of FIG. 8A.

FIG. 8A is a timing diagram exemplarily illustrating scan signals output in a second mode of a display device of FIG. 1, and FIG. 8B is a timing diagram exemplarily illustrating start signals corresponding to scan signals of FIG. 8A.

Hereinafter, the $k^{th}$ p-type scan signal SPk will be described as the p-type scan signal SPk, and the $k^{th}$ n-type scan signal SNk will be described as the n-type scan signal SNk.

Referring to FIGS. 1, 8A, and 8B, the number of p-type scan signals SPk supplied to the second period P2 may change according to a driving frequency of the second mode.

In an exemplary embodiment, as the second driving frequency DFA2 decreases, the number of p-type scan signals SPk supplied during each of frame periods of the second period P2 may be decreased.

As shown in FIG. 8A, one p-type scan signal SPk may be supplied to the p-type scan line during each of frame period of the second period P2 in response to the second driving frequency DFA2, and two p-type scan signals SPk may be supplied to the p-type scan line during each of frame period of the second period P2 in response to a third driving frequency DFA3. The third driving frequency DFA3 may be greater than the second driving frequency DFA2. For example, the third driving frequency DFA3 may be 20 Hz and the second driving frequency DFA2 may be 1 Hz. However, the inventive concepts are not limited to a particular number of p-type scan signals SPk output according to the driving frequency.

As shown in FIG. 8B, as the second driving frequency DFA2 decreases, the pulse width of the first start signal SSP1 corresponding to each of the frame periods of the second period P2 may be decreased. In the first cycle C1 driven by the second driving frequency DFA2, the first start signal SSP1 corresponding to the bias period BP may have a second width W2. In the second cycle C2 driven by third driving frequency DFA3, the first start signal SSP1 corresponding to the bias period BP may have a third width W3. Since the third driving frequency DFA3 is greater than the second driving frequency DFA2, the third width W3 may be greater than second width W2.

The first scan driver 200 may output the p-type scan signal SPk in synchronization with a predetermined clock signal included in the logic low-level period of the first start signal SSP1. The number of p-type scan signals SPk may be determined by the width of the first start signal SSP1.

As such, in the second mode, the number of p-type scan signals supplied to the bias period BP is adaptively adjusted according to change of the driving frequency, thereby improving a flicker, which may otherwise occur in a low frequency driving, and power consumption.

Figure 9:
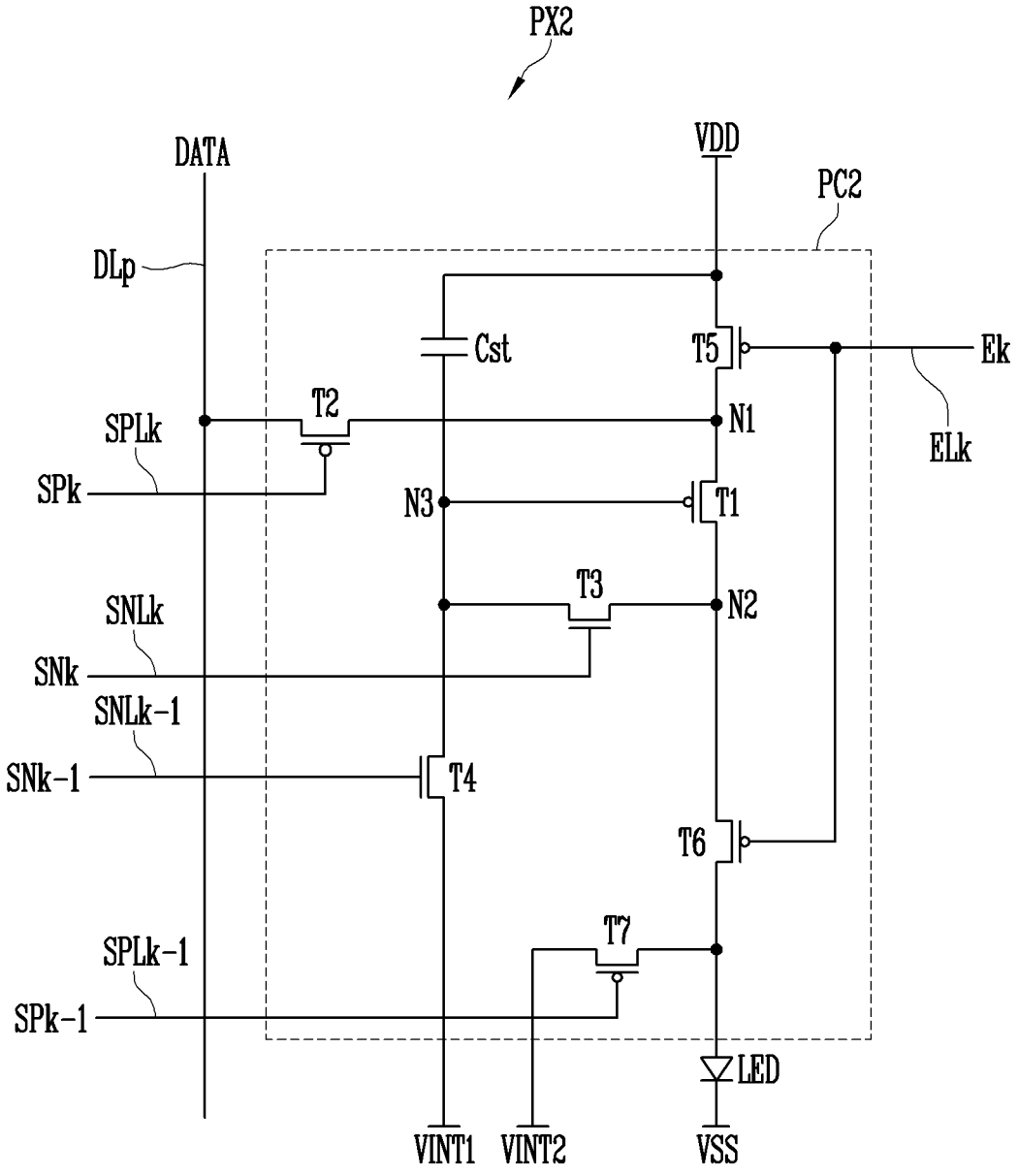
FIG. 9 is a circuit diagram exemplarily illustrating a pixel included in a display device of FIG. 1.

FIG. 9 is a circuit diagram exemplarily illustrating a pixel included in a display device of FIG. 1.

Since the pixel PX2 of FIG. 9 has substantially the same configuration and operates in a manner substantially similar to those of the pixel PX1 of FIG. 2, except for a part of the configuration of the seventh transistor T7 included in a pixel circuit PC2, repeated descriptions of the substantially similar elements will be omitted to avoid redundancy.

Referring to FIGS. 2 and 9, the pixel PX2 may include a light emitting element LED and a pixel circuit PC2 connected thereto.

The pixel circuit PC2 controls an amount of current flowing from the first power supply VDD to the second power supply VSS via the light emitting element LED in response to the data voltage DATA.

The pixel circuit PC2 may include first to seventh transistors T1 to T7 and a storage capacitor Cst.

The fourth transistor T4 may be connected between the third node N3 and the first initialization power supply VINT1. The fourth transistor T4 may include a gate electrode receiving the $k-1^{th}$ n-type scan signal SNk-1.

The seventh transistor T7 may be connected between the second initialization power supply VINT2 and a first electrode (e.g., anode) of the light emitting element LED. The seventh transistor T7 may include a gate electrode receiving the $k-1^{th}$ p-type scan signal SPk-1.

Since the fourth transistor T4 and the seventh transistor T7 are respectively connected to different initialization power supplies VINT1 and VINT2, an initialization operation of the gate voltage of the first transistor T1 and an initialization operation of a voltage of an anode of the light emitting element LED may be improved.

As described above, a display device according to exemplary embodiments and the driving method thereof may initialize an anode and apply an on-bias to a first transistor during a bias period in a second mode. As such, a flicker that may be generated due to low frequency driving of 20 Hz or less (e.g., 1 Hz) may be reduced or minimized. In addition, the number of p-type scan signals supplied during a bias period is set to be less than the number of p-type scan signals supplied during one frame and/or a write period of a first mode, thereby preventing an increase in load due to toggling for generating p-type scan signals and further reducing power consumption in the second mode.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising:

a display panel including a plurality of pixels connected to a p-type scan line, an n-type scan line, and a data line, and configured to display an image in a first mode driven by a first driving frequency or in a second mode driven by a second driving frequency lower than the first driving frequency;

a first scan driver configured to supply a p-type scan signal having a first voltage to the p-type scan line; and a second scan driver configured to supply an n-type scan signal having a second voltage greater than the first voltage to the n-type scan line, wherein:

the second mode includes a first period corresponding to one frame period and a second period including a plurality of consecutive frame periods;

the first scan driver is configured to supply i number of p-type scan signals to the p-type scan line during the first period, and the second scan driver is configured to supply i number of n-type scan signals to the n-type scan line during the first period, i being a natural number; and during at least one of the consecutive frame periods of the second period, the first scan driver is configured to supply j number of p-type scan signals to the p-type scan line, j being a natural number different from i.

2. The display device of claim 1, wherein the first scan driver is configured to supply the j number of p-type scan signals to the p-type scan line in each of the frame periods of the second period.

3. The display device of claim 2, wherein a number of the p-type scan signal supplied during each of the frame periods of the second period is less than a number of the p-type scan signal supplied during the first period.

4. The display device of claim 2, wherein the first scan driver is configured to reduce a number of the p-type scan signal output in each of the frame periods of the second period as the second driving frequency decreases.

5. The display device of claim 1, wherein the second scan driver is configured to not supply the n-type scan signal during the second period.

6. The display device of claim 1, wherein:

the first scan driver is configured to supply the i number of p-type scan signals to the p-type scan line during one frame period in the first mode; and the second scan driver is configured to supply the i number of the n-type scan signals to the n-type scan line during one frame period in the first mode.

7. The display device of claim 1, wherein the first scan driver and the second scan driver are configured to simultaneously supply the p-type scan signal and the n-type scan signal to the p-type scan line and the n-type scan line during the first period, respectively.

8. The display device of claim 1, further comprising a timing controller configured to supply the same number of start signals to the first scan driver and the second scan driver in the first mode, and supply a different number of start signals to the first scan driver and the second scan driver in the second mode.

9. The display device of claim 8, wherein the timing controller is further configured to supply a first start signal having a first width to the first scan driver and a second start signal having the first width to the second scan driver, in response to the first period in the second mode.

10. The display device of claim 9, wherein the timing controller is configured to supply the first start signal having a second width less than the first width to the first scan driver in response to the second period of the second mode.

11. The display device of claim 10, wherein the timing controller is configured to reduce the second width of the first start signal as the second driving frequency decreases.

12. The display device of claim 10, wherein the timing controller is configured to not supply the second start signal to the second scan driver in response to the second period of the second mode.

13. The display device of claim 1, further comprising an emission driver configured to supply an emission control signal to an emission control line connected to each of the pixels to define an emission period and a non-emission period.

14. The display device of claim 1, further comprising a data driver configured to supply a data signal to the data line.

15. The display device of claim 1, wherein each of the pixels comprises:

a light emitting element;

a first transistor connected between a first node electrically connected to a first power supply and a second node electrically connected to a first electrode of the light emitting element, and configured to control a driving current;

a second transistor connected between the data line and the first node, and configured to be turned on by the p-type scan signal supplied to a $k^{th}$ p-type scan line, k being a natural number greater than 1;

a third transistor connected between the second node and a third node connected to a gate electrode of the first transistor, and configured to be turned on by the n-type scan signal supplied to a $k^{th}$ n-type scan line;

a fourth transistor connected between the third node and an initialization power supply, and configured to be turned on by the n-type scan signal supplied to a $(k\text{-}1)^{th}$ n-type scan line;

a fifth transistor connected between the first power supply and the first node, and configured to be turned on by an emission control signal supplied to a $k^{th}$ emission control line;

a sixth transistor connected between the second node and the first electrode of the light emitting element, and configured to be turned on by the emission control signal;

a seventh transistor connected between the initialization power supply and the first electrode of the light emitting element, and configured to be turned on by the p-type scan signal supplied to a $(k\text{-}1)^{th}$ n-type scan line; and a storage capacitor connected between the first power supply and the third node.

16. The display device of claim 15, wherein:

the first and second transistors comprise p-type low-temperature poly-silicon (LTPS) thin film transistors; and the third and fourth transistors comprise n-type oxide semiconductor thin film transistors.

17. A driving method of a display device including a plurality of pixels connected to a p-type scan line, an n-type scan line, and a data line, for displaying an image in a first mode driven by a first driving frequency or in a second mode driven by a second driving frequency lower than the first driving frequency, the method comprising:

supplying i number of p-type scan signals to the p-type scan line in a first period corresponding to one frame period, and supplying i number of n-type scan signals to the n-type scan line in the first period, i being a natural number greater than 1; and supplying j number of p-type scan signals to the p-type scan line in each frame period in a second period including a plurality of consecutive frame periods, j being a natural number less than i, wherein the first period and the second period are included in the second mode.

18. The driving method of claim 17, wherein a number of the p-type scan signal supplied during each of the frame periods of the second period decreases as the second driving frequency decreases.

19. The driving method of claim 17, further comprising supplying the i number of the p-type scan signals to the p-type scan line and the i number of the n-type scan signals to the n-type scan line in each frame period included in the first mode.

* * * * *